US008159434B2

(12) United States Patent
Kimura

(10) Patent No.: US 8,159,434 B2
(45) Date of Patent: Apr. 17, 2012

(54) DRIVING DEVICE FOR LIQUID CRYSTAL DISPLAY PANEL AND LIQUID CRYSTAL DISPLAY DEVICE

(75) Inventor: Hiroaki Kimura, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 1074 days.

(21) Appl. No.: 11/688,029

(22) Filed: Mar. 19, 2007

(65) Prior Publication Data

US 2007/0216624 A1 Sep. 20, 2007

(30) Foreign Application Priority Data

Mar. 20, 2006 (JP) ..... 2006-077254

(51) Int. Cl.
*G09G 3/36* (2006.01)

(52) U.S. Cl. ..... 345/89; 345/88; 345/94; 345/100; 345/204

(58) Field of Classification Search ..... 345/88, 345/205, 690–692, 76–83, 89, 94–96, 204, 345/208–210, 100; 315/169.3; 313/463, 313/504

See application file for complete search history.

(56) References Cited

U.S. PATENT DOCUMENTS

2004/0125064 A1* 7/2004 Adachi et al. ..... 345/89
2005/0001802 A1* 1/2005 Lee ..... 345/89

FOREIGN PATENT DOCUMENTS

| | | | |
|---|---|---|---|
| JP | 3174186 | A | 4/2002 |
| JP | 200299249 | A | 4/2002 |
| JP | 2002-229521 | A | 8/2002 |
| JP | 20033241721 | A | 6/2003 |
| JP | 2004-109332 | A | 4/2004 |
| JP | 2004264828 | A | 9/2004 |
| JP | 200599843 | A | 4/2005 |
| JP | 2006267360 | A | 10/2006 |

OTHER PUBLICATIONS

Communication dated Nov. 8, 2011 from the Japanese Patent Office in counterpart application No. 2006-077254.

* cited by examiner

*Primary Examiner* — Lun-Yi Lao
*Assistant Examiner* — Insa Sadio
(74) *Attorney, Agent, or Firm* — Sughrue Mion, PLLC

(57) ABSTRACT

A liquid crystal display panel driving device is provided which is capable of reliably improving a response speed of a liquid crystal and of obtaining good display quality. When overshooting driving is performed in a current frame for displaying, an excessive response level in a next frame is predicted based on a combination of a gray level in one past frame and a gray level in a current frame and, when an excessive response is predicted, a corrected gray-level value to prevent (or to cancel) the excessive response is calculated in advance. By applying a voltage corresponding to the corrected gray-level value, an excessive response in a next frame can be suppressed. Irrespective of whether or not an excessive response is predictable in a next frame, an overshooting driving can be performed at an applied voltage sufficiently corresponding to a target gray-level value and, as a result, a response speed of a liquid crystal can be reliably made high and good display quality can be obtained.

11 Claims, 12 Drawing Sheets

*FIG. 7*

39

| Gray-level Value of Previous Frame | Gray-level Value of Current Frame | | | | | | | | |
|---|---|---|---|---|---|---|---|---|---|
| | 0 | 8 | 16 | 24 | 32 | 40 | 48 | 56 | 63 |
| 0 | 0 | 1 | 4 | 13 | 16 | 18 | 15 | 7 | 0 |
| 8 | 0 | 0 | 2 | 9 | 12 | 16 | 14 | 7 | 0 |
| 16 | 0 | -2 | 0 | 4 | 8 | 13 | 12 | 7 | 0 |
| 24 | 0 | -3 | -3 | 0 | 3 | 8 | 10 | 6 | 0 |
| 32 | 0 | -4 | -4 | -2 | 0 | 4 | 8 | 6 | 0 |
| 40 | 0 | -5 | -6 | -5 | -5 | 0 | 6 | 5 | 0 |
| 48 | 0 | -6 | -8 | -8 | -9 | -5 | 0 | 3 | 0 |
| 56 | 0 | -7 | -10 | -11 | -13 | -11 | -6 | 0 | 0 |
| 63 | 0 | -8 | -14 | -17 | -21 | -29 | -34 | -20 | 0 |

*FIG. 8*

41

| Gray-level Value of Previous Frame | Gray-level Value of Current Frame | | | | | | | | |
|---|---|---|---|---|---|---|---|---|---|
| | 0 | 8 | 16 | 24 | 32 | 40 | 48 | 56 | 63 |
| 0 | 0 | 0 | 0 | 1 | 1 | 0 | 1 | 0 | 0 |
| 8 | 0 | 0 | 0 | 0 | 1 | 1 | 1 | 0 | 0 |
| 16 | 0 | 0 | 0 | 0 | 0 | -1 | 1 | 0 | 0 |
| 24 | 0 | 0 | 0 | 0 | 0 | 0 | 1 | 0 | 0 |
| 32 | 0 | 0 | 0 | 0 | 0 | 0 | 0 | 0 | 0 |
| 40 | 0 | 0 | 0 | 0 | 0 | 0 | 0 | 0 | 0 |
| 48 | 0 | 0 | 0 | 0 | 0 | 0 | 0 | 0 | 0 |
| 56 | 0 | 0 | 0 | 0 | 0 | 0 | 0 | 0 | 0 |
| 63 | 0 | 0 | 0 | 0 | -1 | -1 | -1 | 0 | 0 |

*42*

| *Excessive Response Level* | | *Excessive Response Correcting Gray Level* |
|---|---|---|
| *0* | *0* | *0* |
| *0* | *1* | *-1* |
| *1* | *0* | *1* |
| *1* | *1* | *3* |

DRIVING DEVICE FOR LIQUID CRYSTAL DISPLAY PANEL AND LIQUID CRYSTAL DISPLAY DEVICE

BACKGROUND OF THE INVENTION

1. Field of the Invention

The present invention relates to a driving device for a liquid crystal display panel and a liquid crystal display device having the driving device and more particularly to the driving device for a liquid crystal display panel and the liquid crystal display device capable of performing an overshooting driving operation in which an overvoltage exceeding a target voltage to be reached at time of completion of a response of a liquid crystal is applied to increase a response speed of the liquid crystal.

The present application claims priority of Japanese Patent Application No. 2006-077254 filed on Mar. 20, 2006, which is hereby incorporated by reference.

2. Description of the Related Art

A conventional liquid crystal display device is so configured that displaying of a gray shade is achieved by changing a voltage to be applied to a liquid crystal layer making up a liquid crystal display panel for every pixel in each frame to change transmittance of a liquid crystal. Moreover, in order to obtain a desired gray-level value (target gray level) by a rapid response of a liquid crystal even when a comparatively abrupt change in gray levels (that is, a change in transmittance) is requested, an overshooting operation is performed in which a specified overvoltage exceeding a target voltage corresponding to a target gray level to be reached at time of completion of a response is applied [(for example, see Patent Reference 1 (Japanese Patent Application Laid-open No. 2002-2295219)].

The conventional liquid crystal display device 101, as shown in FIG. 14, has a liquid crystal display panel 102 and a driving circuit 103 to drive the liquid crystal display panel 102. The driving circuit 103 includes an overshoot calculating section 104 to calculate a proper overshoot amount, a storing section 105 to store processing programs, various blocks of data, or a like, a timing control section 106 to control output timing of video signals, a data electrode driving circuit 107 to supply displaying signals (data signals) to each signal line of the liquid crystal display panel 102, and a scanning electrode driving circuit 108 to supply scanning signals to each scanning line. The liquid crystal display device 101 is, for example, a normally white mode liquid crystal display panel.

The storing section 105 has a frame memory 109 serving as an image memory and an LUT (hereinafter, Look Up Table) storing section 110 to store the LUT. The frame memory 109 stores one frame of image data. The LUT storing section 110 stores the LUT containing gray-level data for overshooting driving corresponding to transition of gray levels In the LUT, an overshoot amount corresponding to transition of gray levels (combination of a gray level in one past frame and a gray level in a current frame for displaying) is shown as an increase of a gray-level value relative to a target gray-level value.

The overshoot calculating section 104 detects an overshoot amount corresponding to a gray-level value of an input current frame (n-th frame video data Fn) and a gray-level value of one past frame [(n−1)-th frame video data Fn−1] obtained from the frame memory 109 from an LUT stored in the LUT storing section 110 and outputs gray-level data obtained by addition of the overshoot amount thereto so that a corresponding voltage is applied to a liquid crystal. Here, the overshoot amount, if a gray-level value in a current frame is larger than a gray-level value in one past frame, becomes large, as shown as Vb (tb≦t≦tc) in FIG. 16, so that a specified overvoltage being higher than a voltage corresponding to a gray-level value in a current frame is applied to a liquid crystal layer and, if a gray-level value in a current frame is smaller than a gray-level value in one past frame, becomes small, as shown as Vd (tf≦t≦tg) so that a specified voltage being lower than a voltage corresponding to a gray-level value in a current frame is applied to a liquid crystal layer. Thus, a movement of a liquid crystal is speeded up to reach a target gray level so that a liquid crystal layer corresponding to the target gray level has specified transmittance before the completion of the liquid crystal response.

For example, as shown in FIG. 15, when transmittance T is to be changed from Ta (ta≦t≦tb) to Tb (tb≦t≦tc, tc≦t≦td, td≦t≦te, te≦t≦tf), though an original applied voltage (target voltage) V corresponding to the voltage Tb is, as shown in FIG. 16, Vc, by applying an overvoltage Vb exceeding the voltage Vc, at time (tb≦t≦tc), to rapidly raise the voltage V from Va, jumping over Vc and to Vb, a response speed of a liquid crystal display panel can be made higher. Similarly, when transmittance T is to be changed from Tb (tb≦t≦tc, tc≦t≦td, td≦t≦te, te≦t≦tf) to Tc (tf≦t≦tg, tg≦t≦th, th≦t≦ti), though an original applied voltage (target voltage) V corresponding to the voltage Tc is, as shown in FIG. 16, the voltage Ve, a voltage Vd being lower than the voltage Ve is applied at time (tf≦t≦tg).

However, as shown in FIG. 15, in some cases, an excessive response in which transmittance T exceeds transmittance Tb corresponding to a target gray level occurs (reached gray level is larger than a target gray level) in a frame (tc≦t≦td) subsequent to a frame (tb≦t≦tc) in which an overshooting driving operation is performed, which causes degradation of displaying quality. Therefore, an amount of overshooting driving was not sufficient conventionally. That is, there was no choice but to suppress an overshoot amount in necessary frames to prevent an excessive response in a succeeding frame.

To solve this problem, technology is disclosed (for example, Patent Reference 2 [(Japanese Patent Application Laid-open No. 2004-1093329)] in which a pattern of transition in gray levels from a gray level existed at least two frames before up to a gray-level in a current frame is detected and, when the gray-level transition pattern is a predetermined one, the driving is performed so that an overshoot amount is decreased. The disclosed liquid crystal display device 201, as shown in FIG. 17, has a liquid crystal display panel 202 and a driving circuit 203 to drive the liquid crystal display panel 202. The driving circuit 203, as shown in FIG. 17, includes an overshoot calculating section 204 to calculate a proper overshoot amount, a storing section 205 to store processing programs, various blocks of data, or a like, a timing control section 206 to control output timing of video signals, a data electrode driving circuit 207 to supply display signals (data signals) to each signal line of the liquid crystal display panel 202, and a scanning electrode driving circuit 208 to supply scanning signals to each scanning line.

The storing section 205 has frame memories 209 and 210 and an LUT storing section 211 to store many LUTs. Each of the frame memories 209 and 210 stores image data [(n−1)-th frame video data: Fn−1] existed one frame period before relative to image data (n-th frame video data: Fn) to be displayed in one frame this time and image data [(n−1)-th frame video data: Fn−1] existed two frame periods before relative to image data (n-th frame video data: Fn) to be displayed this time in one frame. Moreover, the LUT storing section 211 stores a lot of LUTs including gray level data for overshooting driving corresponding to transition in gray levels. In each of the LUTs, an overshoot amount corresponding to transition of gray levels (combination of a gray level in one past frame and a gray level in a current frame for displaying) is shown. The overshoot amount varies for each LUT and a corresponding LUT is selected responsive to a pattern of transition in detected gray levels.

The first problem to be solved is that, even when the conventional technology disclosed in the Patent Reference 1 is applied in which a measure is taken by decreasing the overshoot amount under a specified condition, a sufficient overshooting driving can not be performed and it is made impossible to reliably improve a response speed to provide excellent quality of display. Also, the second problem to be solved is that, even when, for example, the conventional technology disclosed in the Patent Reference 2 is applied, an increase in capacity of a frame memory occurs and many LUTs become necessary and an amount of calculation for judging processes or a like is increased, as a result, causing a rise in costs. For example, the capacity of frame memory to store at least two frames of image data are required as a result.

SUMMARY OF THE INVENTION

In view of the above, it is a first object of the present invention to provide a driving device for a liquid crystal display panel, and a liquid crystal display device which are capable of reliably improving a response speed of a liquid crystal and of obtaining excellent display quality, and a liquid crystal display device having the above driving device. Also, it is a second object of the present invention is to provide the driving device for a liquid crystal display panel, and the liquid crystal display device, which are capable of reducing costs.

According to a first aspect of the present invention, there is provided a driving device for a liquid crystal display panel wherein the liquid crystal display panel includes a plurality of data electrodes arranged along a first direction, a plurality of scanning electrodes arranged along a second direction being approximately orthogonal to the first direction, and a liquid crystal layer, wherein the driving device applies scanning signals to the plurality of scanning electrodes and display signals providing gray levels to the plurality of corresponding data electrodes to write pixel data providing gray levels on corresponding pixels of the liquid crystal layer in the liquid crystal display panel, and wherein, by the driving device, overshoot gray-level data (or, undershoot gray-level data) is generated based on input display data for each pixel and, for a pixel on which an overshooting operation is to be performed this time (or, on which an undershooting operation is to be performed this time), gray-level data or overshoot gray-level data (or, undershoot gray-level data) is set to be somewhat lower by a specified amount (in the case of undershooting driving, the data is set to be somewhat higher by a specified amount) and is applied to each of the data electrodes.

In the foregoing, a preferable mode is one that wherein includes;

a gray-level data outputting circuit to generate and output the gray-level data or the overshoot gray-level data (or, undershoot gray-level data); and a data electrode driving circuit to perform an overshooting driving (or, undershooting driving) by applying the displaying signals to the data electrodes so that, when the data electrode driving circuit receives the overshoot gray-level data (or, undershoot gray-level data), a gray-level voltage to be applied to the pixel corresponds to the overshoot gray-level data (or, undershoot gray-level data) and becomes an overvoltage being larger than a reference voltage (in the case of undershooting driving, becomes an undervoltage being smaller than the reference voltage, wherein the gray-level data outputting circuit includes:

an overshoot gray-level value calculating unit (or, undershoot gray-level value calculating unit) to calculate an overshoot gray-level value (or, undershoot gray-level value) in a current frame based on a current gray-level value in the current frame in which an overshooting driving is performed and a previous gray-level value;

a correcting unit to predict an excessive response that may occur in a next-time frame displaying based on the current gray-level value and the previous gray-level value and to obtain a level of an excessive response or a corrected amount of the next-time gray-level to prevent an excessive response; and a corrected gray-level value calculating unit to calculate a corrected gray-level value or overshoot gray-level value (or undershoot gray-level value) based on a level of the excessive response or the corrected amount of the next-time gray-level value.

Here, in the description, meaning of the term "frame" has a wide concept including a field. Also, the "previous gray-level value" denotes, in addition to a gray-level value in one past frame, a wide-concept gray-level value including a gray-level value in two or more previous frames.

Also, a preferable mode is one wherein the correcting unit includes an excessive response level estimating unit to predict an excessive response at time of displaying in the next-time frame based on the current gray-level value and the previous gray-level value at time of displaying for overshooting driving (or, for undershooting driving) in the current frame and estimates a level of the excessive response.

Also, a preferable mode is one that wherein includes an image information storing unit to store at least one frame of image information.

Also, a preferable mode is one wherein the image information storing unit stores information obtained by adding a level of the excessive response in the next frame or the corrected amount to image information in the current frame.

Also, a preferable mode is one wherein the excessive response level estimating unit sends out information obtained by adding a level of the excessive response in the next-time frame to image information in the current frame to the image information storing unit and the corrected gray-level value calculating unit receives a level of the excessive response from the image information storing unit at time of displaying in a frame and calculates the corrected amount based on a level of the excessive response and obtains a corrected gray-level value or overshoot gray-level value (or, undershoot gray-level value) based on the corrected amount.

Also, a preferable mode is one that wherein includes an overshoot gray-level value storing unit (or, undershoot gray-level value storing unit) to store the overshoot gray-level value (or, undershoot gray-level value) corresponding to the current gray-level value and the previous gray-level value and a corrected amount storing unit corresponding to the current gray-level value and the previous gray-level value.

Also, a preferable mode is one that wherein includes an excessive response level storing unit to store a level of the excessive response corresponding to the current gray-level value and the previous gray-level value.

Also, a preferable mode is one wherein the overshoot gray-level value storing unit (or, undershoot gray-level value storing unit) stores the overshoot gray-level value (or undershoot gray-level value) actually measured in advance and the corrected amount storing unit stores the corrected amount actually measured in advance and the excessive response level storing unit stores the excessive response level actually measured in advance.

According to a second aspect of the present invention, there is provided a liquid crystal display device including:

a liquid crystal display panel which comprises a plurality of data electrodes arranged along a first direction, a plurality of scanning electrodes arranged along a second direction being approximately orthogonal to the first direction, and a liquid crystal layer; and a driving device for a liquid crystal display panel which applies scanning signals to the plurality of scanning electrodes and applies display signals providing gray levels to the plurality of corresponding data electrodes to write pixel data providing gray levels on corresponding pixels of the liquid crystal layer; wherein the driving device applies scanning signals to the plurality of scanning electrodes and display signals providing gray levels to the plurality of corresponding data electrodes to write pixel data providing gray levels on corresponding pixels of the liquid crystal layer in the liquid crystal display panel, and wherein, by the driving device, overshoot gray-level data (or, undershoot gray-level data) is generated based on input display data for each pixel and, for a pixel on which an overshooting operation is performed this time (or, on which an undershooting operation is performed this time), gray-level data or overshoot gray-level data (or, undershoot gray-level data) is set to be somewhat lower by a specified amount (in the case of undershooting driving, the data is set to be somewhat higher by a specified amount) and is applied to each of the data electrodes.

According to a third aspect of the present invention, there is provided a liquid crystal display device including:

a liquid crystal display panel which includes a plurality of data electrodes arranged along a first direction, a plurality of scanning electrodes arranged along a second direction being approximately orthogonal to the first direction, and a liquid crystal layer; and a driving device for a liquid crystal display panel which applies scanning signals to the plurality of scanning electrodes and applies display signals providing gray levels to the plurality of corresponding data electrodes to write pixel data providing gray levels on corresponding pixels of the liquid crystal layer; wherein the driving device for the liquid crystal display includes the driving device for the liquid crystal display panel described above.

With the above configuration, overshoot gray-level data (undershoot gray-level data) is generated based on input display data for each pixel and is applied to corresponding data electrode and, for a pixel on which an overshooting operation is performed this time (or, on which an undershooting operation is performed this time), gray-level data or overshoot gray-level data (undershoot gray-level data) is set to be somewhat lower by a specified amount and is applied to data electrodes (in the case of undershooting driving, the data is set to be somewhat higher by a specified amount) and, therefore, it is made possible to prevent an excessive response, and, for example, irrespective of whether or not an excessive response is predictable in a next frame, an overshooting driving can be performed at an applied voltage sufficiently corresponding to a target gray-level value and, as a result, a response speed of a liquid crystal can be reliably made high and good display quality can be obtained. Moreover, as image information to be used to obtain a corrected amount of a gray level, information in a current frame and in one past frame to the current frame is sufficient and, therefore, it is made possible to suppress an increase in capacity of the image storing means to store image information and costs.

BRIEF DESCRIPTION OF THE DRAWINGS

The above and other objects, advantages, and features of the present invention will be more apparent from the following description taken in conjunction with the accompanying drawings in which:

FIG. 7 is a diagram showing contents of a first LUT stored in the first LUT storing section making up the storing section of the liquid crystal display device according to the first embodiment of the present invention;

FIG. 8 is a diagram showing contents of a second LUT stored in the second LUT storing section making up the storing section of the liquid crystal display device according to the first embodiment of the present invention;

DETAILED DESCRIPTION OF THE PREFERRED EMBODIMENTS

Best modes of carrying out the present invention will be described in further detail using various embodiments with reference to the accompanying drawings. By generating overshoot gray-level data (or, undershoot gray-level data) based on input display data for each pixel and by applying the data to corresponding data electrode and, for a pixel on which an overshooting operation is performed (or, on which an undershooting operation is performed), by setting gray-level data or overshoot gray-level data (or, undershoot gray-level data) to be somewhat lower by a specified amount to be applied to data electrodes (in the case of undershooting driving, the data is set to be somewhat higher by a specified amount) to prevent an excessive response, and, for example, irrespective of whether or not an excessive response is predictable in the next frame, by performing an overshooting driving at an applied voltage sufficiently corresponding to a target gray-level value, the first purpose of the present invention that a response speed of a liquid crystal can be reliably improved and good display quality can be obtained is realized. Moreover, by using, as image information to be used to obtain a corrected amount of a gray level, information in a current frame and in one past frame to the current frame being sufficient, the second purpose that an increase in capacity of the image storing means to store image information and costs are suppressed is achieved.

First Embodiment

Figure 1:
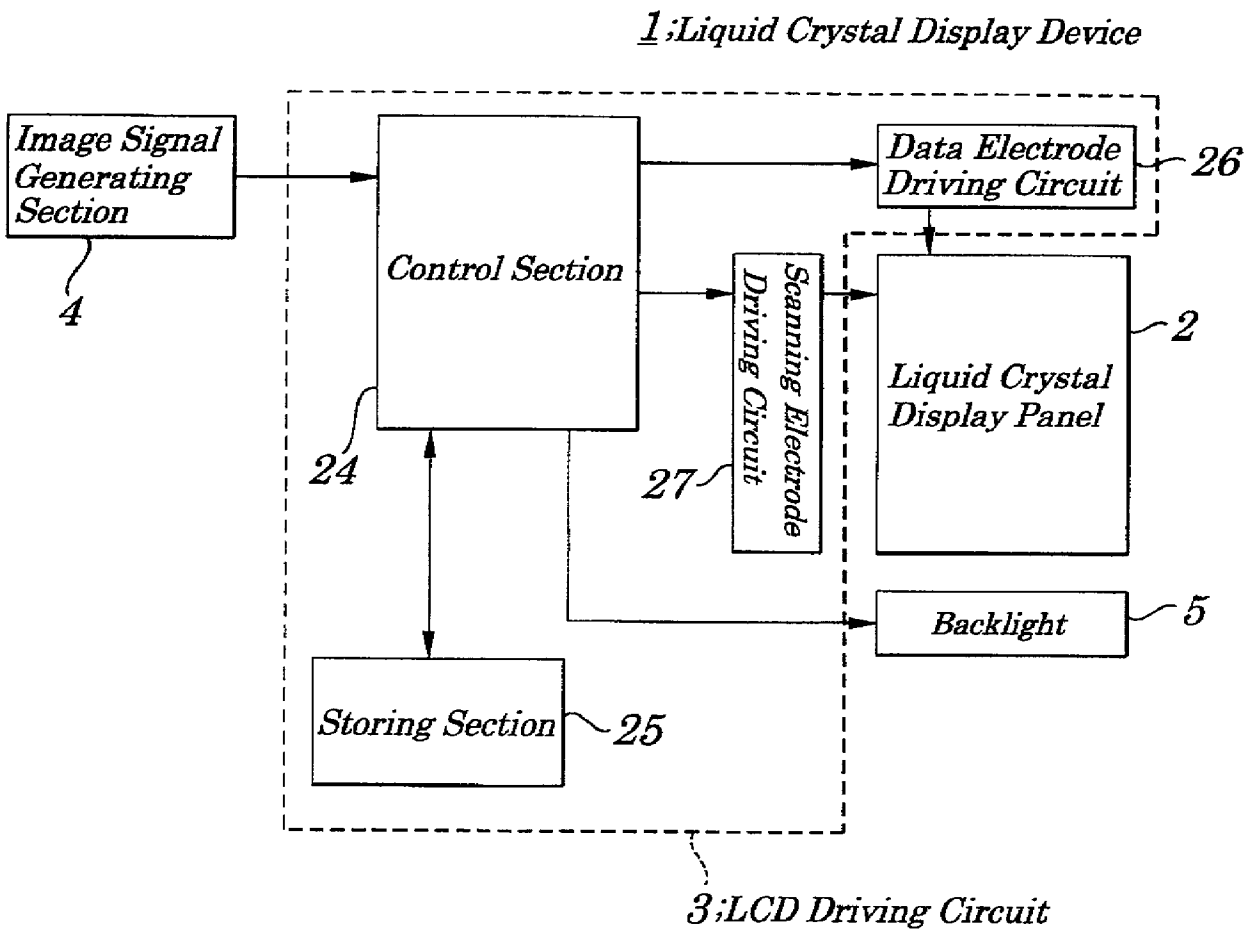
FIG. 1 is a block diagram showing electrical configurations of a liquid crystal display device according to a first embodiment of the present invention.
Figure 2:
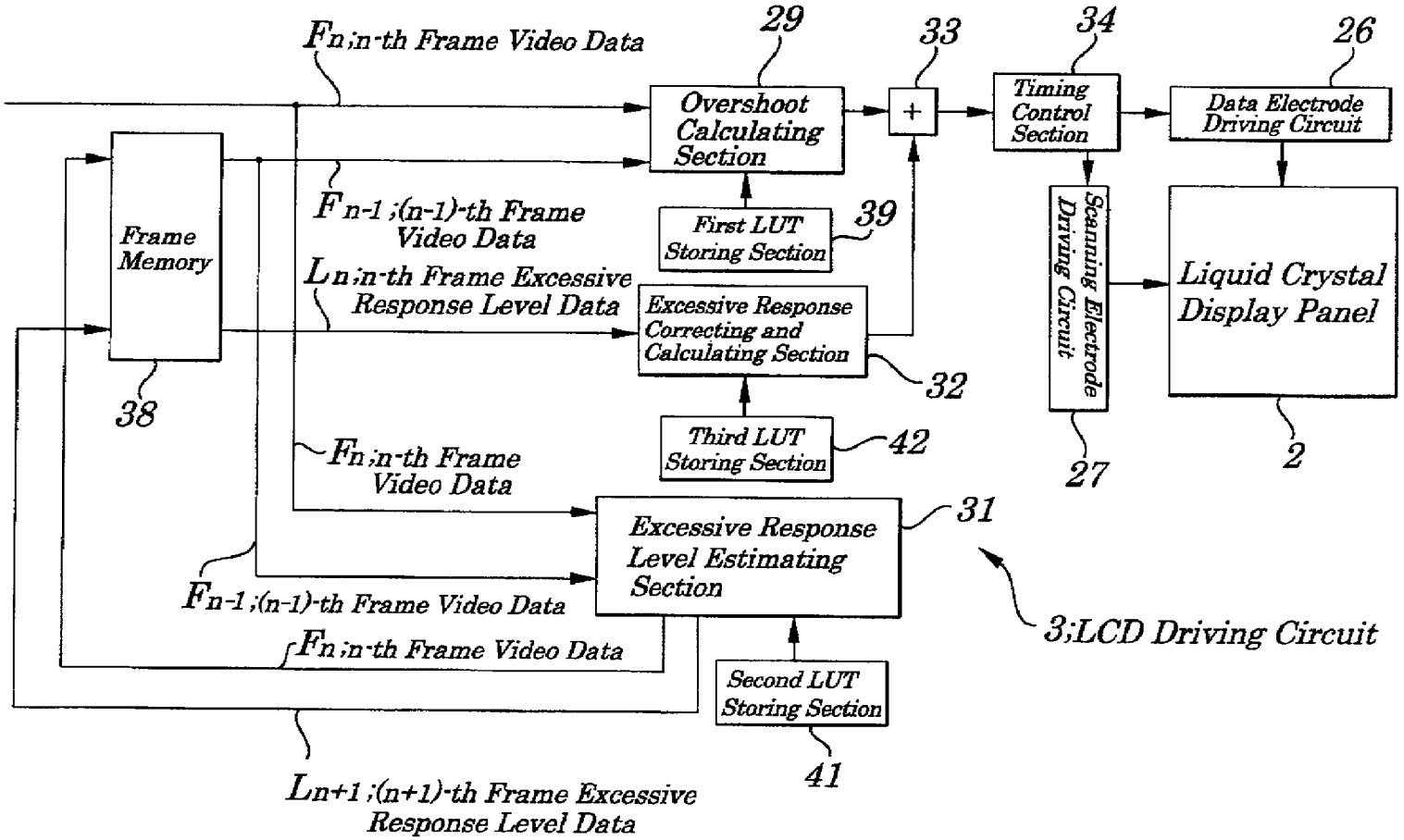
FIG. 2 is a block diagram showing electrical configurations of an LCD (Liquid Crystal Display) driving circuit making up the liquid crystal display device according to the first embodiment of the present invention.
Figure 3:
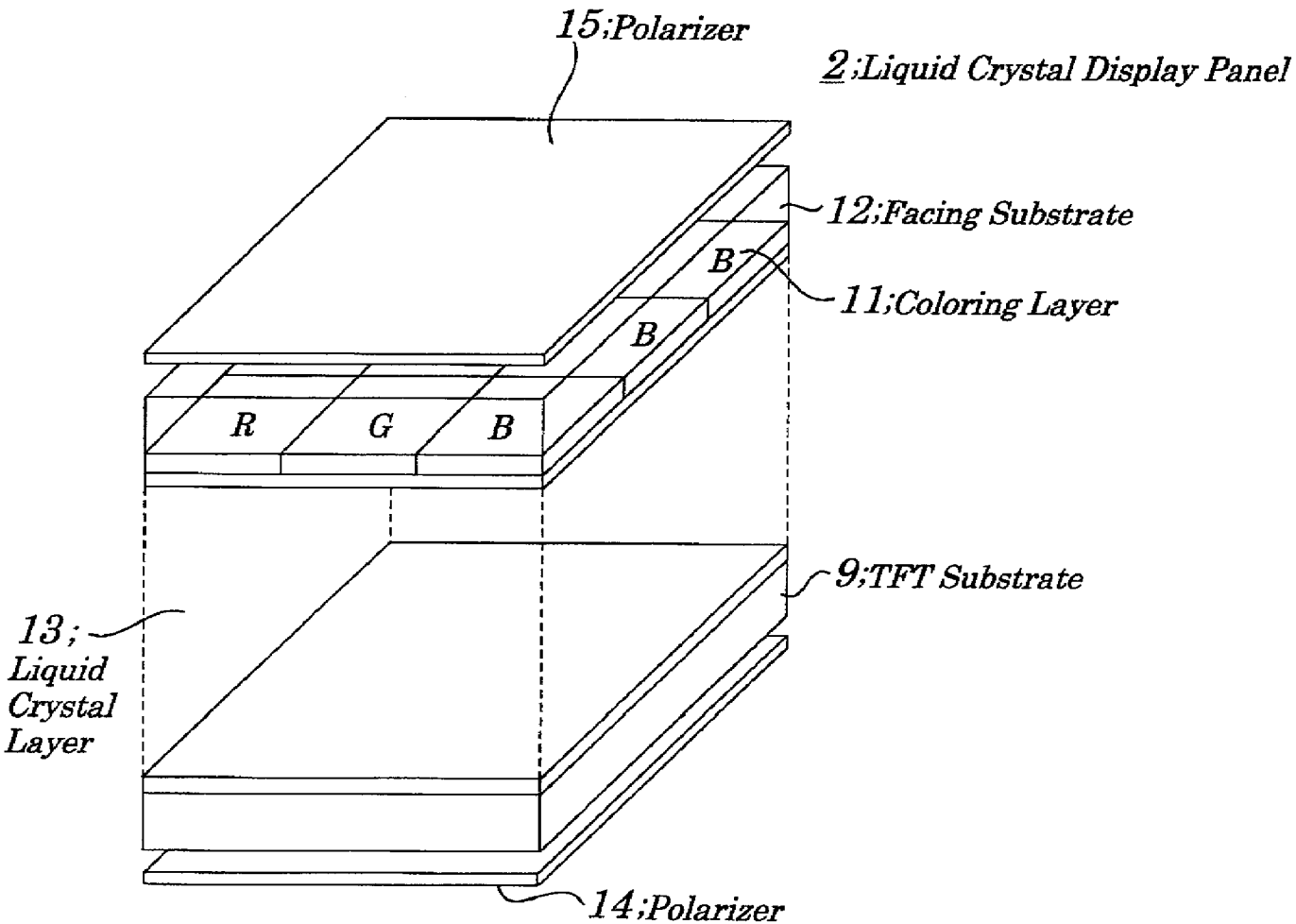
FIG. 3 is a perspective view schematically showing configurations of a liquid crystal display panel making up the liquid crystal display device according to the first embodiment of the present invention.
Figure 4:
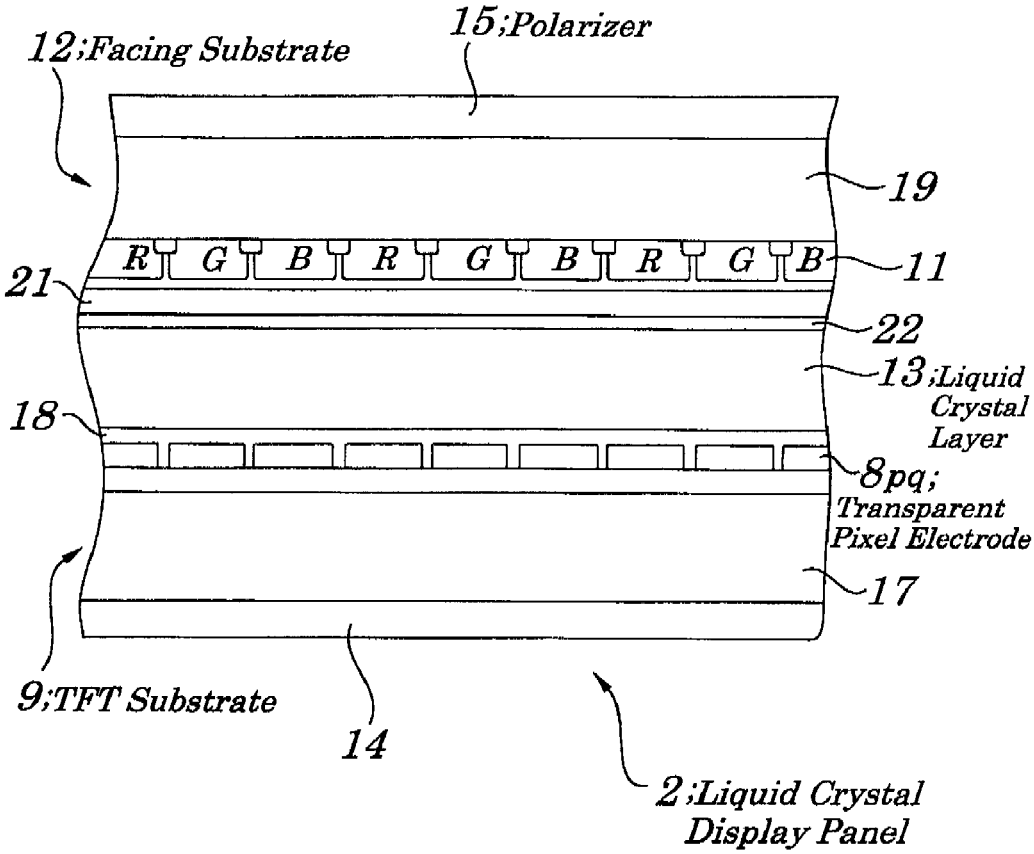
FIG. 4 is a cross-sectional view schematically showing configurations of the liquid crystal display panel of FIG. 3.
Figure 5:
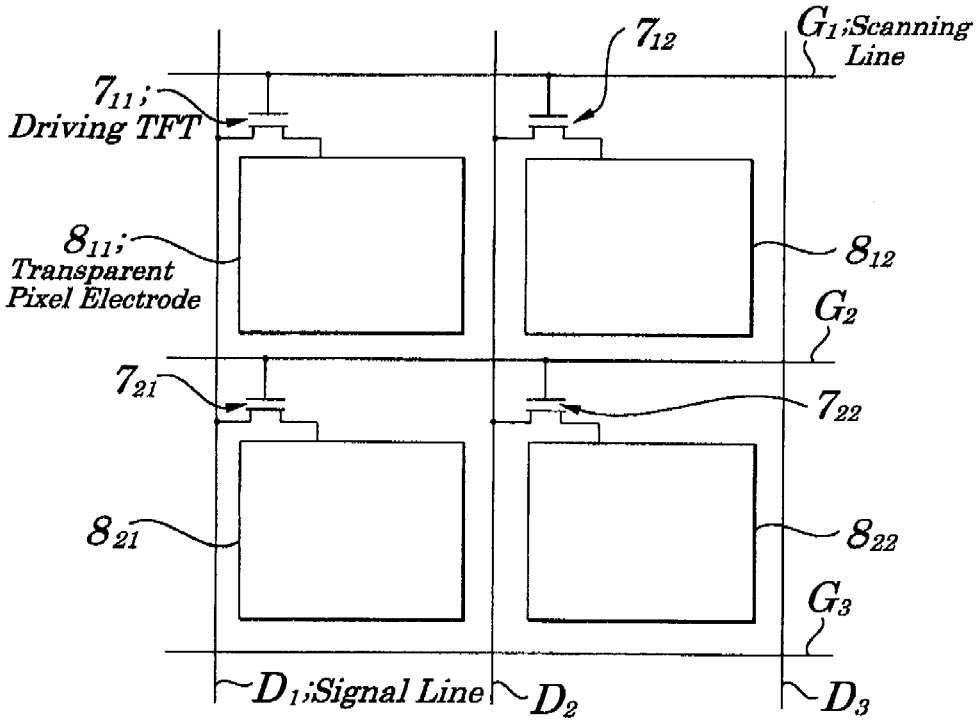
FIG. 5 is a diagram of an equivalent circuit showing electrical configurations of the liquid crystal display panel of FIG. 3.
Figure 6:
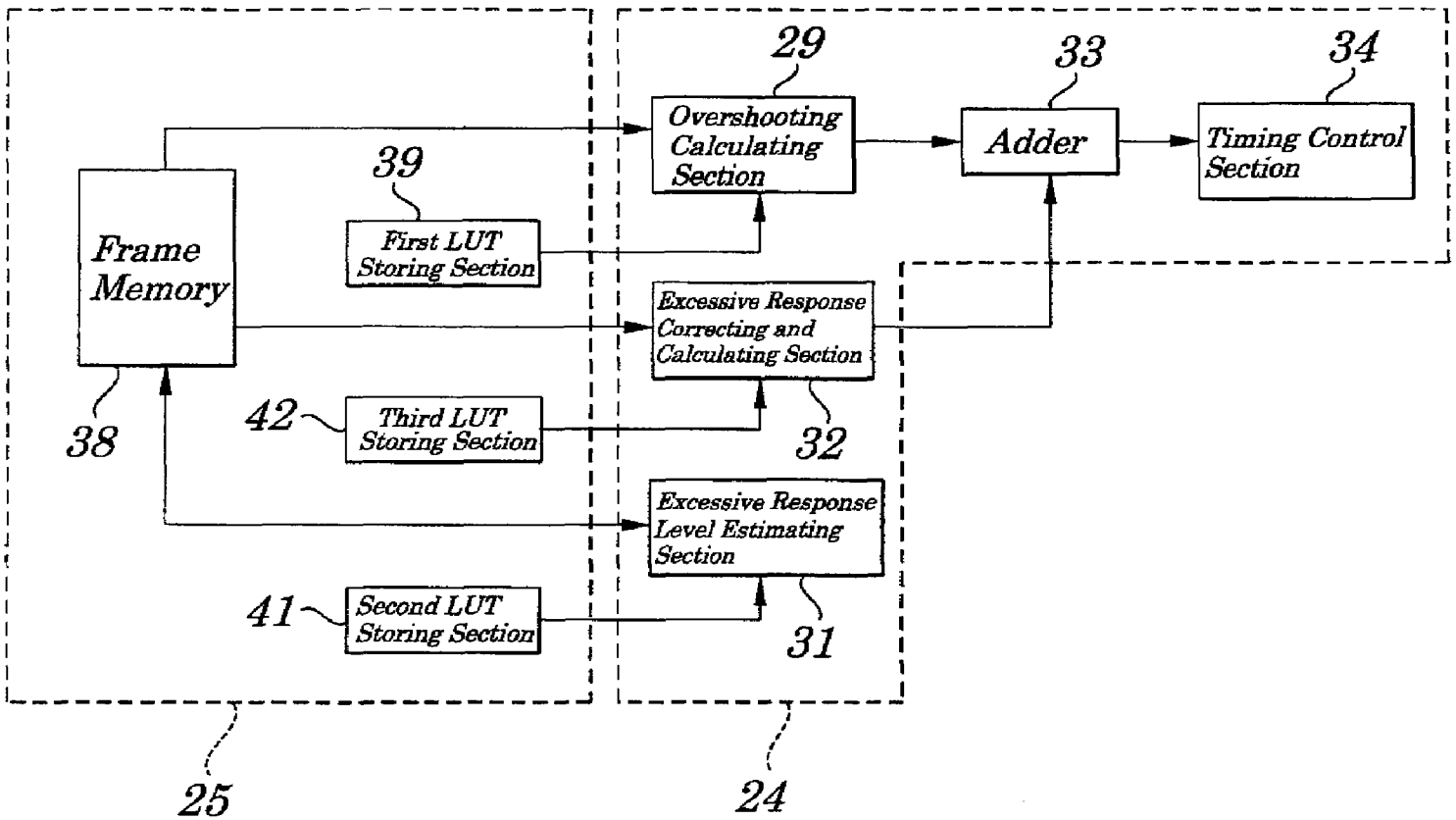
FIG. 6 is a block diagram showing configurations of a control section and a storing section of the liquid crystal display device according to the first embodiment of the present invention.
Figures 9, 10:
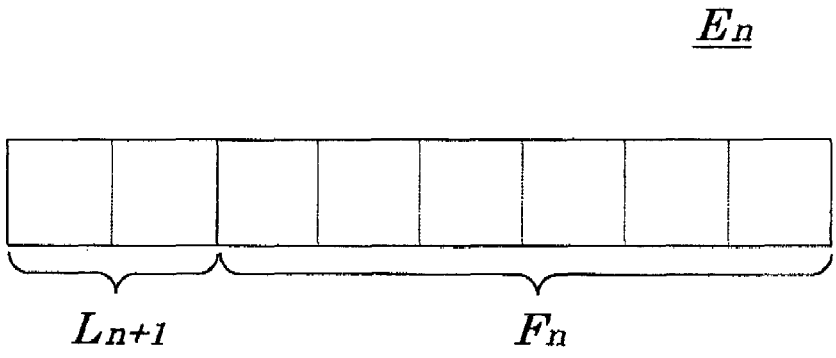
FIG. 9 is a diagram showing contents of a third LUT stored in the third LUT storing section making up the storing section of the liquid crystal display device according to the first embodiment of the present invention.
FIG. 10 is a diagram showing a format of a frame data stored in the frame memory making up the storing section of the liquid crystal display device according to the first embodiment of the present invention.
Figure 11:
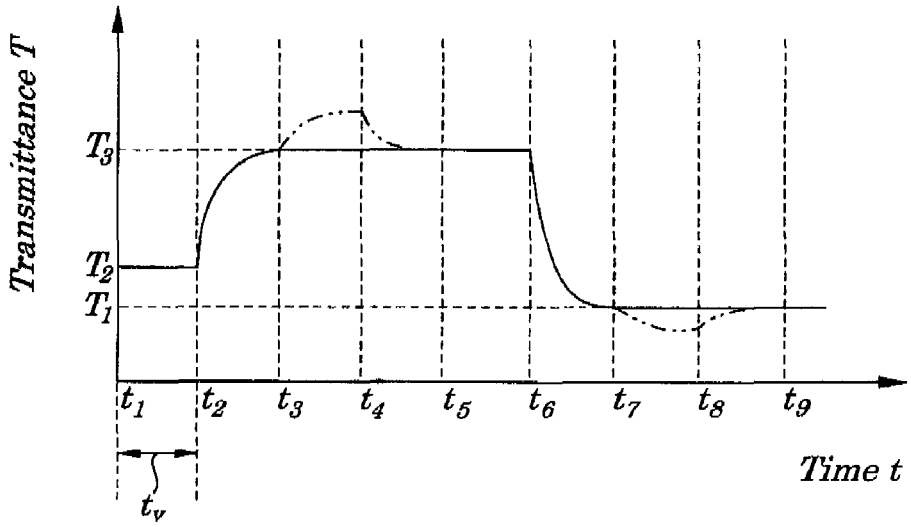
FIG. 11 is a diagram explaining operations of the LCD driving circuit of the liquid crystal display device according to the first embodiment of the present invention.
Figure 12:
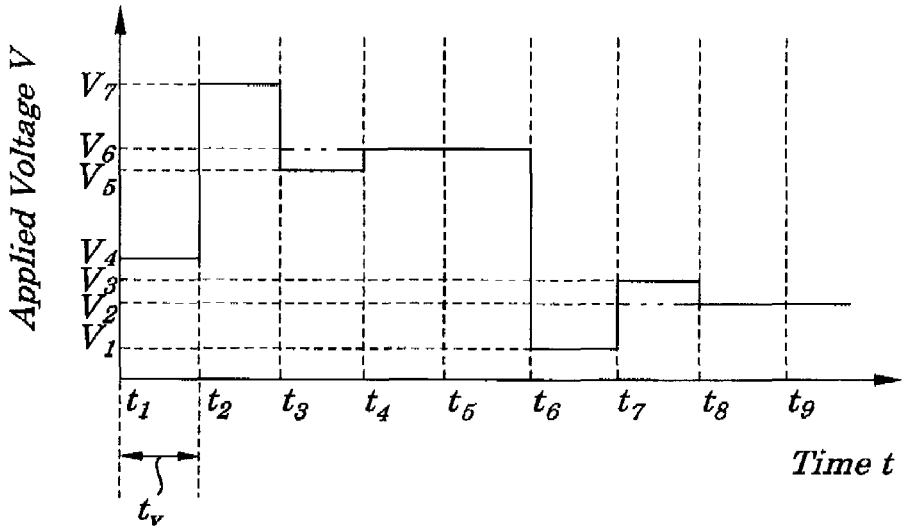
FIG. 12 is also a diagram explaining operations of the LCD driving circuit of the liquid crystal display device according to the first embodiment of the present invention.
Figure 13:
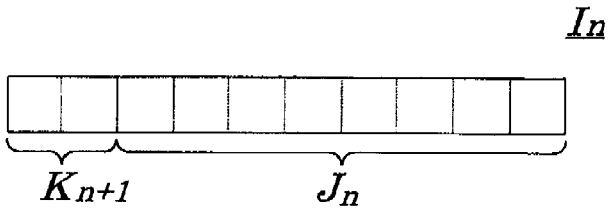
FIG. 13 is a diagram showing a format of frame data stored in the frame memory making up the storing section of the liquid crystal display device according to the first embodiment of the present invention.
Figure 14:
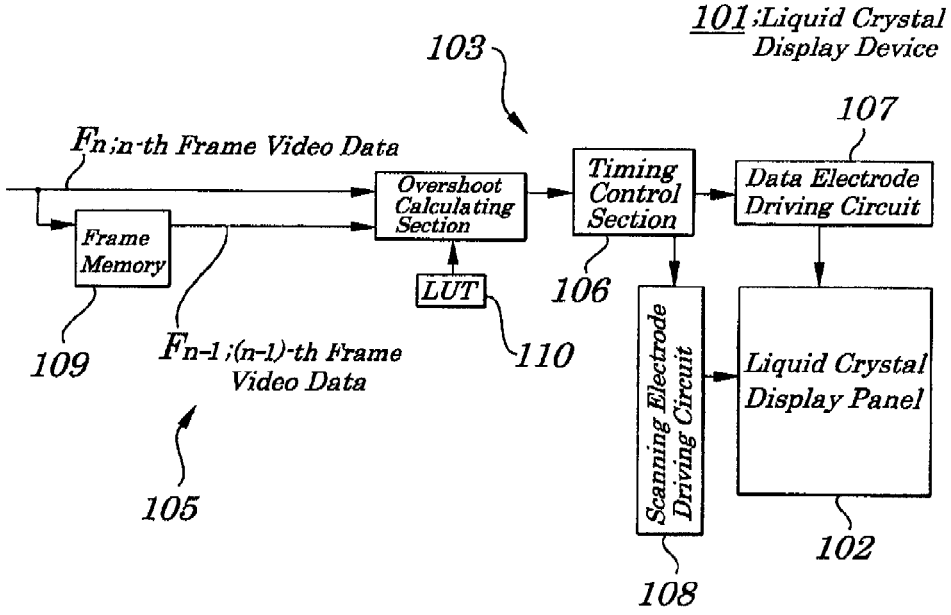
FIG.14 (RELATED ART)
FIG. 14 is a diagram explaining a conventional technology.
Figure 15:
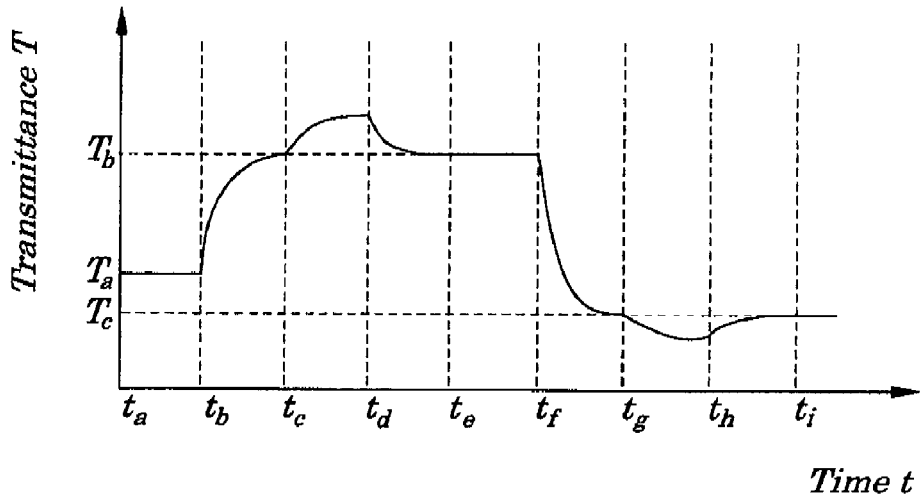
FIG. 15 (RELATED ART)
FIG. 15 is a diagram explaining the conventional technology.
Figure 16:
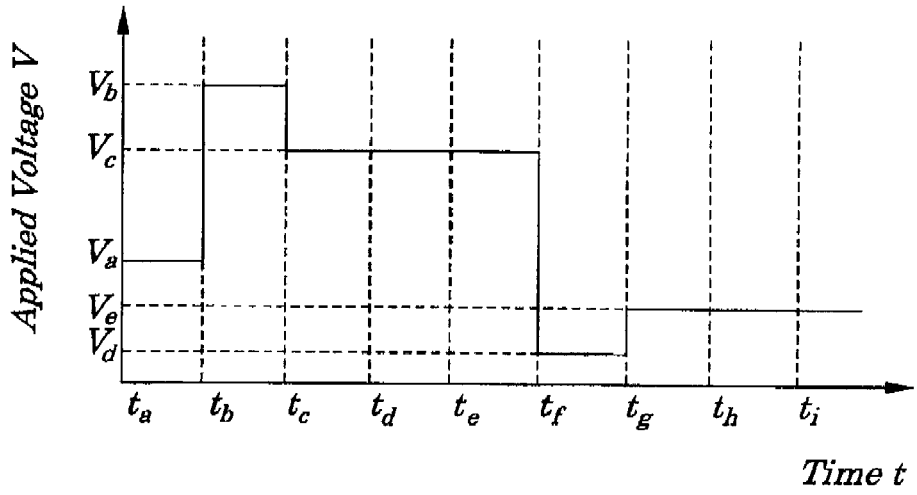
FIG. 16 (RELATED ART)
FIG. 16 is a diagram explaining the conventional technology.
Figure 17:
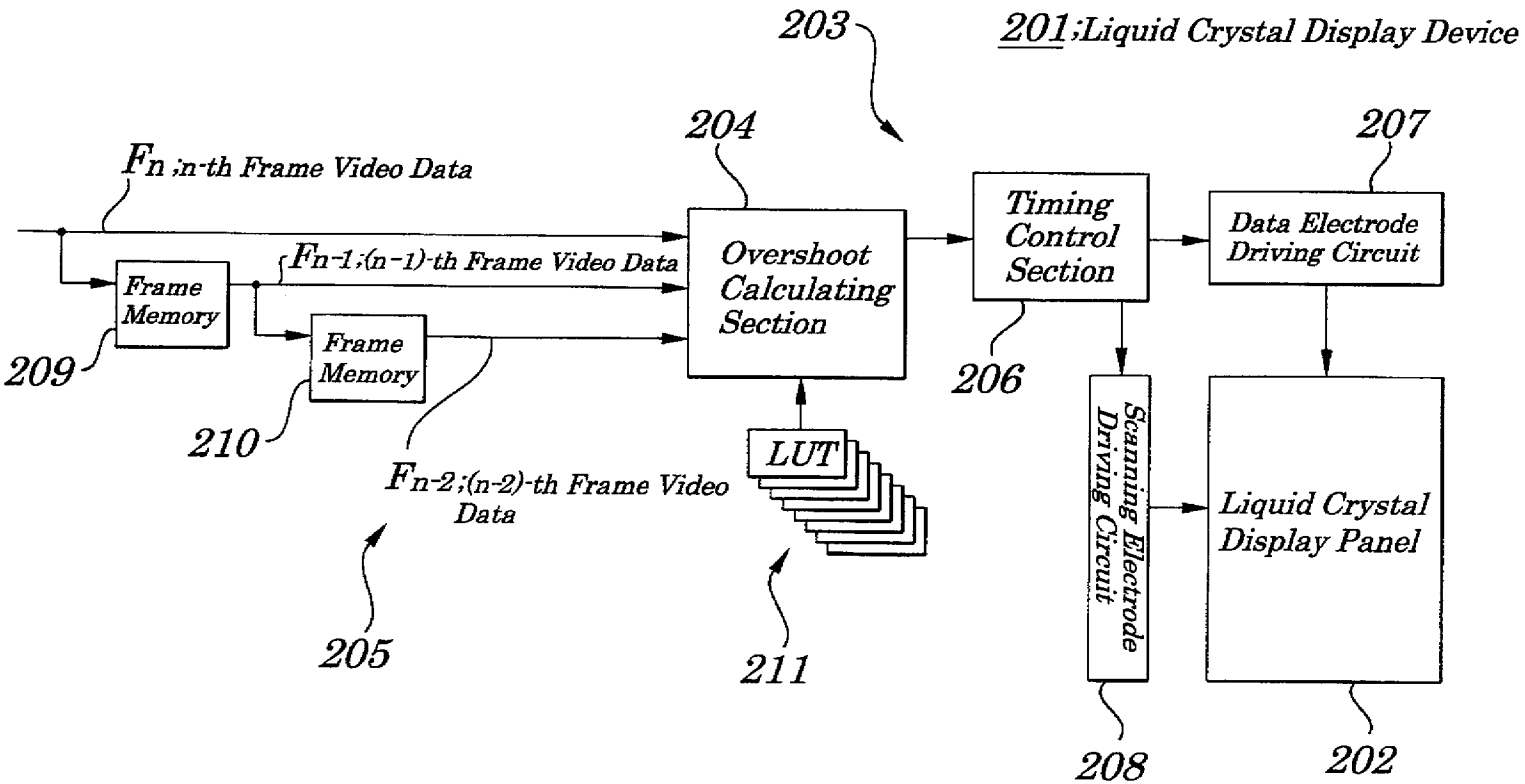
FIG.17(RELATED ART)
FIG. 17 is a diagram explaining the conventional technology.

FIG. 1 is a block diagram showing electrical configurations of a liquid crystal display device of a first embodiment of the present invention. FIG. 2 is a block diagram showing electrical configurations of an LCD (Liquid Crystal Display) driving circuit making up the liquid crystal display device of the first embodiment. FIG. 3 is a perspective view schematically showing configurations of a liquid crystal display panel making up the liquid crystal display device of the first embodiment. FIG. 4 is a cross-sectional view schematically showing configurations of the liquid crystal display panel of FIG. 3. FIG. 5 is a diagram of an equivalent circuit showing electrical configurations of the liquid crystal display panel of FIG. 3. FIG. 6 is a block diagram showing configurations of a control section and a storing section of the liquid crystal display device of the first embodiment. FIG. 7 is a diagram showing contents of a first LUT stored in the first LUT storing section making up the storing section of the liquid crystal display device of the first embodiment. FIG. 8 is a diagram showing contents of a second LUT stored in the second LUT storing section making up the storing section of the liquid crystal display device of the first embodiment. FIG. 9 is a diagram showing contents of a third LUT stored in the third LUT storing section making up the storing section of the liquid crystal display device of the first embodiment. FIG. 10 is a diagram showing a format of a frame data stored in the frame memory making up the storing section of the liquid crystal display device of the first embodiment. FIGS. 11 and 12 are diagrams explaining operations of the LCD driving circuit of the liquid crystal display device of the first embodiment. FIG. 13 is a diagram showing a format of frame data stored in the frame memory making up the storing section of the liquid crystal display device of the first embodiment.

The liquid crystal display device of the first embodiment, shown in FIGS. 1 and 2, includes a liquid crystal display panel 2, an LCD driving circuit 3 to drive the liquid crystal display panel 2, an image signal generating section 4 to generate corresponding image signals based on image data supplied from the outside, a backlight 5 to apply illuminating light to the liquid crystal display panel 2. The liquid crystal display panel 2 is, for example, a transmittance-type liquid crystal display panel having a TFT (Thin Film Transistor) structure and includes, as shown in FIGS. 3 to 5, a TFT substrate 9 on which driving TFTs p q (p and q are natural numbers) and many transparent pixel electrodes 8 p q are mounted, a facing substrate 12 mounted in a fixed manner to face the TFT substrate 9 so as to have a coloring layer (color filter layer) 11 with a gap being several μm in length interposed between the facing substrate 12 and the TFT substrate, a liquid crystal layer 13 sealed in the gap, and a pair of polarizers 14 and 15 arranged outside of the TFT substrate 9 and facing substrate 12. Moreover, in the embodiment, a normally-white-mode liquid crystal display panel is employed. Furthermore, the subscript such as "p" in the driving TFT p q denotes the number of the row and "q" denoting the number of the column. For example, the TFT p q shows that the TFT is located in the p row and q column and is the driving TFT connected to the p-th scanning line Gp and to the q-th signal line Dq.

On the TFT substrate 9 are formed a lot of transparent pixel electrodes $\mathbf{8}_{11}, \mathbf{8}_{12}, \ldots$ in a matrix form and scanning lines Gp to supply scanning signals and signal lines Dq to supply displaying signals being orthogonal to one another in a portion surrounding the transparent electrodes $\mathbf{8}_{11}, \mathbf{8}_{12}, \ldots$. Each of the scanning signals and displaying signals is input from each outside input terminal connected to outside circuits. The driving TFTs p q is arranged in a neighboring portion of each intersection of each of the scanning lines Gp and signal lines Dq and is used as a switching element, with its source electrode being connected to each transparent pixel electrode 8 p q to apply a signal electric charge to a liquid crystal cell.

The driving TFT 7 p q is driven and controlled by inputs of scanning signals supplied through the scanning lines Gp to its gate electrode connected to the scanning lines Gp and of displaying signals supplied to the drain electrode connected to the signal lines Dq. Moreover, the source electrode of the driving TFT 7 p q is connected via a contact hole to the transparent pixel electrode 8 p q. The TFT substrate 9 has a structure in which layers of each electrode, insulating film, or a like are stacked. That is, a gate electrode is formed on the transparent insulating substrate 17. The gate electrode is coated with a gate insulating film. On the gate insulating film in an upper portion of the gate electrode is formed a semiconductor layer. On the gate insulating film are formed drain electrodes and source electrodes being in contact with the semiconductor layer. The gate insulating film, semiconductor layer, drain electrode, and source electrode are coated with a passivation film. A specified portion of the passivation film is coated with an ITO (Indium Tin Oxide) film.

Thus, the driving TFT p q is formed on the transparent insulating substrate 17. A specified portion of the ITO film is used for each of the transparent pixel electrodes 8 p q. On the transparent pixel electrode layer (ITO film) 8 p q are formed a liquid crystal orientation film 18 in a manner to coat the transparent pixel electrode layers 8 p q. In the facing substrate 12, on the transparent insulating substrate 19 is arranged the coloring layer 11 made up of red, green, and blue coloring portions. The facing electrode 21 is formed in a manner to cover the coloring layers 11. On the facing electrode 21 is formed the liquid crystal orientation film 22 in a manner to cover the facing electrode 21. The liquid crystal orientation film 18 making up the TFT substrate 9 is formed in a manner to face the liquid crystal orientation film 22 making up the facing substrate 12 and the liquid crystal layer 13 is sandwiched between the liquid crystal orientation film 18 and the liquid crystal orientation film 22.

The LCD driving circuit 3, as shown in FIGS. 1 and 2, includes a control section 24 having a CPU (Central Processing Unit) to perform a specified control function and calculating function, a storing section 25 made up of a semiconductor memory such as a ROM (Read Only Memory), RAM (Random Access Memory) or a like to store processing programs to be executed by the control section 24 and various blocks of data, a data electrode driving circuit 26 to supply displaying signals (data signals) to each of the signal lines Dq, and a scanning electrode driving circuit (gate driver) 27 to supply scanning lines to each of the scanning lines Gp.

The control section 24, as shown in FIGS. 2 and 6, includes an overshoot calculating section 29 to calculate a proper overshoot amount, an excessive response level estimating section 31 to estimate an excessive response level in a succeeding frame after the overshooting driving, an excessive response correcting and calculating section 32 to calculate a corrected amount required to suppress an excessive response, an adder 33 to calculate a corrected overshoot amount and to output the overshoot amount to the timing control section 34, and a timing control section 34 to control output timing of a video signal. Moreover, in the embodiment, the term "overshoot" includes, in addition to the overshoot in a narrow sense, an undershoot. The storing section 25 has a program storing section to store programs and an information storing section to store information. The program storing section stores an overshoot calculation processing program, excessive response level estimation processing program, excessive response correction calculating program, or a like.

The information storing section includes a frame memory 38 serving as an image memory, the first LUT storing section 39 to store the first LUT, the second LUT storing section 41 to store the second LUT, and the third LUT storing section 42 to store the third LUT. The frame memory 38 stores one frame of image data. Frame data "En" for each pixel of a specified [n-th (n is a natural number)] frame, as shown in FIG. 10, consists of video data (n-th frame video data, 6 bits in the embodiment):Fn and excessive response data of one next frame [(n+1)-th frame excessive response level data, 2 bits in the embodiment: Ln+1].

Also, the first LUT storing section 39, as shown in FIG. 7, stores a correspondence table of gray level values for overshooting driving corresponding to gray level transition. In the LUT, an overshoot amount (an increase in gray-level values relative to a target gray level or an gray-level enhancement) corresponding to gray level transition (combination of a gray level in one past frame and a gray level in a current frame for displaying) is shown. A proper overshoot amount is calculated in advance by an experiment. A hatched area in FIG. 7 corresponds to transition in gray levels in which the occurrence of an excessive response is predicted.

Moreover, the second LUT storing section 41, as shown in FIG. 8, stores a correspondence table of gray level values for which the occurrence of an excessive response is predicted and of degrees of the excessive response. In the LUT, an excessive response level [increase amount of gray-level value (negative value in FIG. 8 shows a decrease)] corresponding to a gray level transition (combination of a gray level in one past frame and a gray level value in a current frame for displaying) in a next frame is shown. The excessive response level is obtained in advance by an experiment. A hatched area in FIG. 8 corresponds to gray level transition in which the occurrence of an excessive response is predicted. The third LUT storing section 42, as shown in FIG. 9, stores values for correcting gray-level values to be used for suppression of an excessive response corresponding to an excessive response level. A value for correcting gray-level values is obtained in advance by an experiment. In the embodiment, a value having approximately the same value as the excessive response level and having a reversed in sign is used.

The overshoot calculating section 29 is configured to calculate an overshoot amount (increase in gray-level values relative to a target gray level or an gray-level enhancement) corresponding to gray level transition (combination of a gray level in one past frame and a gray level in a current frame for displaying) so that a proper overvoltage exceeding a target voltage corresponding to a target gray level to be reached at time of completion of a response of a liquid crystal is applied, that is, an overshooting driving is performed, which enables a liquid crystal to make a sharp response to transition in gray levels and the liquid crystal layer 13 corresponding to the target gray level to provide specified transmittance before the completion of the response of a liquid crystal and to output the calculated overshoot gray-level data (see FIGS. 12 to 13).

Moreover, in practice, in order to prevent burn-in of a liquid crystal, a liquid crystal is driven (in an inverted manner) in every specified period (for example, in every frame period) and, in FIG. 12, absolute values of applied voltages are shown, which are provided on a positive polarity side all together.

The overshoot calculating section 29 extracts corresponding gray-level data (overshoot amount) based on video data Fn in a current frame for displaying this time and fed from the image signal generating section 4 and video data Fn−1 in a previous frame stored in and fed from the frame memory 38, by referring to LUTs stored in the first LUT storing section 39. That is, the overshoot calculating section 29 calculates corresponding gray-level data from the video data Fn−1 as a gray-level value in a previous frame and from the video data Fn as a gray-level value in a current frame.

The excessive response level estimating section 31 estimates presence or absence of an excessive response in one next frame of a frame in which a proper overvoltage is applied (overshooting driving is performed) and an excessive response level (magnitude of excessive response) when the excessive response is predicted and outputs the estimated result to the frame memory 38. The excessive response level is calculated as an increase between a target gray level and a reached gray level.

The excessive response level estimating section 31 extracts a response level [increase amount of gray-level value (negative value in FIG. 8 shows a decrease)] in a corresponding next frame based on a video data Fn in a current frame for displaying this time fed from the image signal generating section 4 and a video data Fn−1 in a previous frame fed from the frame memory stored in the frame memory by referring to an LUT stored in the second LUT storing section 41. That is, the excessive response level estimating section 31 calculates a corresponding excessive response level Ln+1 in a next frame from video data Fn−1 as a gray level in a previous frame and a video data Fn as a gray level in a current frame for displaying this time fed from the image signal generating section 4 and sends out the video data Fn and the excessive response level Ln+1 to the frame memory 38.

The excessive response correcting and calculating section 32, when an excessive response has been already predicted in a current frame, calculates a corrected value (corrected amount of a gray level) based on an excessive response level Ln in a current frame estimated by the excessive level estimating section 31 one frame period before and stored in and fed from the frame memory 38. The excessive response correcting and calculating section 32 calculates a corrected value (corrected amount of a gray level) based on the excessive response level Ln in a current frame fed from the frame memory 38 by referring to an LUT stored in the third LUT storing section 42. According to the embodiment, as a result, an excessive response is cancelled out by using a value having approximately the same value of the excessive response level and having a reversed sign.

The adder 33 calculates corrected gray level data by adding a corrected amount of a gray level fed from the excessive response correcting and calculating section 32 to an overshoot gray level data fed from the overshoot calculating section 29 and sends out the corrected gray level data to the timing control section 34. The timing control section 34 outputs a video signal, a start pulse signal, a shift clock signal, and a data latch signal to the data electrode driving circuit 26 and also a start pulse signal and shift clock signal to the scanning electrode driving circuit 27. This causes the control section 24 to perform writing on each pixel 8 p q via the data electrode driving circuit 26 and the scanning electrode driving circuit 27.

The backlight 4 is made up of a light source unit having a plurality of LEDs (Light Emitting Diodes), a light guide plate to receive light emitted from the light source unit and to emit plane-shaped illuminating light to the liquid crystal display panel 2, an optical material group including a diffusing sheet to correct variations in luminance and a prism sheet to gather illuminating light coming in from the light guide plate side and is configured to apply illuminating light to the liquid crystal display panel 2 from its rear side and to make observers visually recognize light having transmitted through the liquid crystal display panel 2.

Next, operations of the LCD driving circuit 3 of the liquid crystal display device 1 of the embodiment are described by referring to FIGS. 2, 11, and 12. First, operations of each component making up the control section 24 in the LCD driving circuit 3 are explained by referring to FIG. 2. The overshoot calculating section 29 is configured to calculate an overshoot amount (increase in gray-level values relative to a target gray level or an gray-level enhancement) corresponding to gray levels (combination of a gray level in one past frame and a gray level in a current frame for displaying) 50 that a proper overvoltage exceeding a target voltage corresponding to a target gray level to be reached at time of completion of a liquid crystal response is applied, that is, an overshooting driving is performed, which enables a liquid crystal to make a sharp response to transition in gray levels and the liquid crystal layer 13 corresponding to the target gray level to provide specified transmittance before the completion of a liquid crystal response and to output the calculated overshoot gray-level data. The overshoot calculating section 29, as shown in FIG. 2, extracts corresponding gray-level data (overshoot amount) based on video data Fn in a current frame for displaying this time and fed from the image signal generating section 4 and video data Fn−1 in a previous frame stored in and fed from the frame memory 38, by referring to LUTs stored in the first LUT storing section 39. That is, the overshoot calculating section 29 calculates corresponding gray-level data from the video data Fn−1 as a gray-level value in a previous frame and from the video data Fn as a gray-level value in a current frame.

The excessive response level estimating section 31 estimates presence or absence of an excessive response in one next frame in a frame in which a proper overvoltage is applied (overshooting driving is performed) and an excessive response level (magnitude of excessive response) when the excessive response is predicted and outputs the estimated result to the frame memory 38. The excessive response level is calculated as an increase between a target gray level and a reached gray level. The excessive response level estimating section 31, as shown in FIG. 2, extracts a response level [increase amount of gray-level value (negative value in FIG. 8 shows a decrease)] in a corresponding next frame based on a video data Fn in a current frame for displaying this time fed from the image signal generating section 4 and a video data Fn−1 in a previous frame fed from the frame memory stored in the frame memory by referring to an LUT stored in the second LUT storing section 41.

That is, the excessive response level estimating section 31 calculates a corresponding excessive response level Ln+1 in a next frame from video data Fn−1 as a gray level in a previous frame and a video data Fn as a gray level in a current frame for displaying this time fed from the image signal generating section 4 and sends out the video data Fn and the excessive response level Ln+1 to the frame memory 38. The excessive response level estimating section 31 sends out video data Fn in a current frame for displaying this time fed from the image signal generating section 4, together with the excessive response level Ln+1, to the frame memory 38.

The excessive response correcting and calculating section 32, as shown in FIG. 2, when an excessive response has been already predicted in a current frame, calculates a corrected value (corrected amount of a gray level) based on an excessive response level Ln in a current frame estimated by the excessive level estimating section 31 one frame period before and stored in and fed from the frame memory 38. The excessive response correcting and calculating section 32 calculates a corrected value (corrected amount of a gray level) based on the excessive response level Ln in a current frame fed from the frame memory 38 by referring to an LUT stored in the third LUT storing section 42. In the embodiment, as a result, an excessive response is cancelled out by using a value having approximately the same value of the excessive response level and having a reversed sign.

The adder 33 calculates corrected gray level data by adding a corrected amount of a gray level fed from the excessive response correcting and calculating section 32 to an overshoot gray level data fed from the overshoot calculating section 29 and sends out the corrected gray level data to the timing control section 34. The timing control section 34 outputs a video signal, a start pulse signal, a shift clock signal, and a data latch signal to the data electrode driving circuit 26 and also a start pulse signal and shift clock signal to the scanning electrode driving circuit 27. This causes the control section 24 to perform writing on each pixel 8 p q via the data electrode driving circuit 26 and the scanning electrode driving circuit 27.

Next, operations of the LCD driving circuit 3 as a whole are described in detail. The control section 24 is configured, as shown in FIG. 11, in order to rapidly raise transmittance T of a liquid crystal, for example, from its level ($T=T_2$) to its level ($T=T_3$) during the period ($t2 \leqq t \leqq t3$), to change an applied voltage V from a voltage ($V=V_4$) not to a voltage ($V=V_6$) corresponding to a target gray level but to a proper overvoltage ($V=V_7$) predetermined responsive to gray level transition, as shown in FIG. 12, and then lowers, during the period ($t3 \leqq t \leqq t4$), the applied voltage V, when the occurrence of an excessive response in the transmittance T of a liquid crystal is predicted if a voltage V to be applied remains to be $V_6$), down to a corrected voltage ($V=V_5$). This causes the transmittance T of a liquid crystal to be maintained to be the transmittance ($T=T_3$) corresponding to a target gray level, as shown in FIG. 11. Moreover, the control section 24 is configured, for example, as shown in FIG. 11, during the period ($t6 \leqq t \leqq t7$), in order to rapidly lower the transmittance T of a liquid crystal from its level ($T=T_3$) down to its level ($T=T_1$), as shown in FIG. 11, to change an applied voltage V from a voltage ($V=V_6$) not to a voltage ($V=V_2$) corresponding to a target gray level but to a proper undervoltage ($V=V_1$) predetermined according to transition of gray levels, as shown in FIG. 11, and then raises, during the period ($t7 \leqq t \leqq t8$), the applied voltage V, when the occurrence of an excessive response in the transmittance T of a liquid crystal is predicted if a voltage V to be applied remains to be $V_2$, up to a corrected voltage ($V=V_3$). This causes the transmittance T of a liquid crystal to be maintained to be the transmittance ($T=T_1$) corresponding to a target gray level, as shown in FIG. 11.

Thus, according to the configurations of the embodiment, when an overshooting driving is performed in a current frame for displaying, an excessive response level in a next frame is predicted based on a combination of a gray level in one past frame and a gray level in a current frame and, when an excessive response is predicted, a corrected gray-level value to prevent (or to cancel) the excessive response is calculated in advance and, therefore, by applying a voltage corresponding to the corrected gray-level value, an excessive response in a next frame can be suppressed and, for example, irrespective of whether or not an excessive response is predictable in a next frame, an overshooting driving can be performed at an applied voltage sufficiently corresponding to a target gray-level value and, as a result, a response speed of a liquid crystal can be reliably made high and good display quality can be obtained.

Here, for example, in a frame when an excessive response is predictable and an overshooting driving is performed, an amount of an overshoot is decreased, and in a frame when an excessive response is predictable and no overshooting driving is performed or no change in gray levels occurs, the excessive response is suppressed by decreasing a predetermined gray-level value and, therefore, an overshooting driving can be made possible at a sufficient voltage whenever necessary, which enables reliable improvement of a response speed of a liquid crystal.

Moreover, as image information to be used to obtain a corrected amount of a gray level, information in a previous frame and in a current frame is sufficient and, therefore, as capacity of a frame memory, a capacity that can save one frame of data is sufficient and, by storing information obtained by adding information on the excessive response level to video signals in a frame, required storage capacity can be reduced. Additionally, a limited number of LUTs is sufficient and many numbers of LUTs are not required unlike in the conventional case. An amount of calculation in the control section can be reduced, which can improve a response speed of a liquid crystal and can reduce costs.

As described above, in the conventional technology, when an overshooting driving is performed and/or a correction is made continuously for two frame periods, in order to store gray-level transition data two times, a frame memory having a capacity to store two frames of image data is required. However, according to the embodiment, gray-level transition in which the occurrence of an excessive response in a next frame is predicted is defined in advance and the predicted excessive response level is stored in the frame memory in a manner to correspond to video data in one past frame in which an excessive response is predictable and, therefore, it is possible to perform an overshooting driving or to make a correction to gray level data continuously for two frame periods by using a frame memory having one frame of storing capacity, which enables reduction of frame memory capacity.

Second Embodiment

Configurations of the second embodiment differ greatly from those in the first embodiment in that information obtained by adding a corrected value itself of a gray level, instead of an excessive response level, to video signals in a frame is stored in a frame memory and, as a result, the excessive response correcting and calculating section is not used. Configurations other than described above are approximately the same as in the first embodiment and same reference numbers as used in FIG. 2 are assigned to components having the same functions as for the first embodiment and their descriptions are omitted accordingly.

The excessive response level estimating section 31 is configured to define, in advance, gray level transition in which the occurrence of an excessive response in a next frame is predicted and to store a corrected value for prevention of a predicted excessive response in the frame memory 38 in a manner to correspond to video data in one past frame of a frame in which an excessive response is predicted. The frame memory 38 stores a corrected value of a gray level in a manner to correspond to video data in one past frame of a frame in which an excessive response is predictable. The adder 33 calculates corrected gray level data by adding a corrected amount of a gray level fed from the frame memory 38 to overshoot gray level data fed from the overshoot calculating section 29.

Thus, according to configurations of the second embodiment, approximately the same effects obtained in the first embodiment can be achieved. Besides, it is made possible to reduce storing capacity and to further lower costs.

It is apparent that the present invention is not limited to the above embodiments but may be changed and modified without departing from the scope and spirit of the invention. For example, in the above embodiments, the control section performs, for example, overshoot calculating processing, excessive response level estimating processing, excessive response correcting and calculating processing, or a like by executing corresponding control programs, however, the present invention is not limited to this and the control section is configured to perform part or all of the overshoot calculating processing, excessive response level estimating processing, excessive response correcting and calculating processing by using special-purpose hardware and part of the processing by using corresponding programs. Also, the control section may be configured to perform functions of the adder and/or the timing control section by executing specified control programs.

Moreover, the overshoot calculating processing, excessive response level estimating processing, excessive response correcting and calculating processing, or a like may be performed separately by CPUs or by one single CPU. Also, for example, the overshoot calculating section and the first LUT storing section may be constructed as one chip. The control section and the storing section may be constructed as one chip. The control section and storing section except the timing control section may be constructed as one chip. The control section except the timing control section and the storing section except the frame memory may be constructed as one chip.

Moreover, as a period (refresh period) during which gray-level data for each pixel is to be updated for displaying, not only a frame period but also a field period may be employed. For example, when video signals of an NTSC (National Television System Committee) system are to be handled, instead of the frame period, the field period may be used, that is, in every field period, gray-level data can be updated and, as one screen of image data, one field of data may be used. Also, an example in which operations are performed in 64 gray levels is described, however, operations in the present invention may be performed in 128 gray levels or in 256 gray levels. In the case of operations in 256 gray levels, a frame data In, as shown in FIG. 13, consists of 8-bit video data Jn in a current frame and 2-bit excessive response level data Kn+1 in one next frame.

Only values corresponding to representative gray levels may be made to be stored in the LUT and intermediate values may be obtained by interpolation. Values corresponding to each gray level may be made to be stored in the LUT. Also, in the present invention, both normally white mode and normally black mode liquid crystal display panels may be employed. As a scanning method, any of progressive scanning and interlaced scanning may be used.

Additionally, the present invention may be applied to not only an active-driving-type liquid crystal display device to but also passive-driving-type liquid crystal display device.

What is claimed is:

1. A driving device for a liquid crystal display panel, wherein said liquid crystal display panel comprises a plurality of data electrodes arranged along a first direction, a plurality of scanning electrodes arranged along a second direction being approximately orthogonal to said first direction, and a liquid crystal layer, and wherein said driving device applies scanning signals to said plurality of scanning electrodes and display signals providing gray levels to the plurality of corresponding data electrodes to write pixel data providing gray levels on corresponding pixels of said liquid crystal layer in said liquid crystal display panel, the driving device comprising;

a gray-level data outputting circuit to generate and output gray-level data or overshoot gray-level data based on input display data in previous and current frames for each pixel; and a data electrode driving circuit to perform an overshooting driving by applying said overshoot gray-level data as the displaying signal to said data electrodes, when said overshoot gray-level data is inputted, so that said overshoot gray-level data becomes an overvoltage being larger than a reference voltage, wherein said gray-level data outputting circuit comprises:

an overshoot amount calculating unit to calculate an overshoot amount in a current frame based on input display data in said previous and current frames for each pixel;

a correcting unit to predict an excessive response that may occur in a next-time frame based on input display data in said previous and current frames and to obtain a corrected amount of input display data in said next-time frame by using a value having approximately a same value as an excessive response level and having a reversed sign, when said excessive response is predicted, thereby preventing said excessive response; and a corrected overshoot amount calculating unit to calculate a corrected overshoot amount based on said corrected amount of said input display data in said next-frame.

2. The driving device for the liquid crystal display device according to claim 1, wherein said correcting unit comprises an excessive response level estimating unit to predict said excessive response at time of displaying in said next-time frame based on input display data in said previous and current frames at time of displaying for overshooting driving in said current frame and estimates said excessive response level.

3. The driving device for the liquid crystal display device according to claim 2, wherein said corrected overshoot amount calculating unit receives said excessive response level estimated by an excess response level estimating unit and calculates said corrected amount of said input display data in said next time frame based on said excessive response level and obtains said correct overshoot amount based on said corrected amount.

4. The driving device for the liquid crystal display device according to claim 1, wherein said overshoot amount is actually measured in advance and stored in a first lookup table, and wherein said corrected amount of input display data in said next-time frame is actually measured in advance and stored in a second lookup table.

5. The driving device for the liquid crystal display device according to claim 1, wherein said excessive response level is actually measured in advance and stored in a third lookup table.

6. A driving device for a liquid crystal display panel, wherein said liquid crystal display panel comprises a plurality of data electrodes arranged along a first direction, a plurality of scanning electrodes arranged along a second direction being approximately orthogonal to said first direction, and a liquid crystal layer, and wherein said driving device applies scanning signals to said plurality of scanning electrodes and display signals providing gray levels to the plurality of corresponding data electrodes to write pixel data providing gray levels on corresponding pixels of said liquid crystal layer in said liquid crystal display panel, the driving device comprising;

a gray-level data outputting circuit to generate and output gray-level data or overshoot gray-level data based on input display data in previous and current frames for each pixel; and a data electrode driving circuit to perform an overshooting driving by applying said overshoot gray-level data as the displaying signal to said data electrodes, when said overshoot gray-level data is inputted, so that said overshoot gray-level data and becomes an overvoltage being larger than a reference voltage, wherein said gray-level data outputting circuit comprises:

an overshoot amount calculating means to calculate an overshoot amount in a current frame based on input display data in said previous and current frames for each pixel;

a correcting means to predict an excessive response that may occur in a next-time frame based on input display data in said previous and current frames and to obtain a corrected amount of input display data in said next-time frame by using a value having approximately a same value as an excessive response level and having a reversed sign, when said excessive response is predicted, thereby preventing said excessive response; and a corrected overshoot amount calculating means to calculate a corrected or overshoot amount based on said corrected amount of said input display data in said next-time frame.

7. The driving device for the liquid crystal display device according to claim 6, wherein said correcting means comprises an excessive response level estimating means to predict said excessive response at time of displaying in said next-time frame based on input display data in said previous and current frames at time of displaying for overshooting driving in said current frame and estimates said excessive response level.

8. The driving device for the liquid crystal display device according to claim 7, wherein said corrected overshoot amount calculating means receives of said excessive response level estimated by an excessive response level estimating means and calculates said corrected amount of said input display data in said next-time frame based on said excessive response level and obtains said correct overshoot amount based on said corrected amount.

9. The driving device for the liquid crystal display device according to claim 6, wherein said overshoot amount is actually measured in advance and stored in a first lookup table, and wherein said corrected amount of input display data in said next-time frame is actually measured in advance and stored in a second lookup table.

10. The driving device for the liquid crystal display device according to claim 6, wherein said excessive response level is actually measured in advance and stored in a third lookup table.

11. A liquid crystal display device comprising:

a liquid crystal display panel which comprises a plurality of data electrodes arranged along a first direction, a plurality of scanning electrodes arranged along a second direction being approximately orthogonal to said first direction, and a liquid crystal layer; and a driving device for a liquid crystal display panel which applies scanning signals to said plurality of scanning electrodes and applies display signals providing gray levels to the plurality of corresponding data electrodes to write pixel data providing gray levels on corresponding pixels of said liquid crystal layer, wherein said driving device applies scanning signals to said plurality of scanning electrodes and display signals providing gray levels to the plurality of corresponding data electrodes to write pixel data providing gray levels on corresponding pixels of said liquid crystal layer in said liquid crystal display panel, wherein said driving device comprises:

a gray-level data outputting circuit to generate and output gray-level data or overshoot gray-level data based on input display data in previous and current frames for each pixel; and a data electrode driving circuit to perform an overshooting driving by applying said overshoot gray-level data as the displaying signal to said data electrodes, when said overshoot gray-level data is inputted, so that said overshoot gray-level data becomes an overvoltage being larger than a reference voltage, wherein said gray-level data outputting circuit comprises:

an overshoot amount calculating unit to calculate an overshoot amount in a current frame based on input display data in said previous and current frames for each pixel;

a correcting unit to predict an excessive response that may occur in a next-time frame based on input display data in said previous and current frames and to obtain a corrected amount of input display data in said next-time frame by using a value having approximately a same value as an excessive response level and having a reversed sign, when said excessive response is predicted, thereby preventing said excessive response; and a corrected overshoot amount calculating unit to calculate a corrected overshoot amount based on said corrected amount of said input display data in said next-time frame.

* * * * *